US005407448A

United States Patent [19]

Brandt et al.

[11] Patent Number: 5,407,448

[45] Date of Patent: Apr. 18, 1995

[54] VELVET DYEING KIT AND METHOD

[76] Inventors: M. Karl Brandt, P.O. Box 1791, Lexington, S.C. 29072; Michael Reedy, 42 First St., Keyport, N.J. 07735

[21] Appl. No.: 120,726

[22] Filed: Sep. 13, 1993

[51] Int. Cl.[6] ..... D06P 5/02; D06P 3/60

[52] U.S. Cl. ..... 8/495; 8/488; 8/442; 8/918; 8/921; 401/176; 401/198

[58] Field of Search ..... 401/176, 198; 8/500, 8/488, 495, 441, 542, 442, 918, 921

[56] References Cited

U.S. PATENT DOCUMENTS

| | | | |
|---|---|---|---|
| 2,862,221 | 12/1958 | Hume | 15/258 |
| 3,203,821 | 8/1965 | Domin | 117/17 |
| 3,751,284 | 8/1973 | Lyons et al. | 117/28 |
| 4,110,071 | 8/1978 | Schaub et al. | 8/529 |
| 4,427,414 | 1/1984 | Orton | 8/529 |
| 4,482,594 | 11/1984 | Stousland | 428/92 |
| 4,557,731 | 12/1985 | Sasakura et al. | 8/531 |
| 4,853,240 | 8/1989 | McShane | 426/250 |

*Primary Examiner*—Paul Lieberman
*Assistant Examiner*—Margaret Einsmann
*Attorney, Agent, or Firm*—Michael A. Mann

[57] ABSTRACT

A kit includes, in a preferred embodiment, untreated, undyed woven velvet-covered shoes, handbags, belts or costume accessories are supplied with an applicator holding a measured mount of a dye plus a finishing solution and a fixer. The velvet is made substantially of cellulosic yarns and the dye is cellulose specific. The finishing solution and fixer are applied, if a sheen is desired, then the dye is applied by brushing the item with the applicator tip until the dye has saturated the item and is used up. The item is allowed to stand at room temperature for at least 24 hours for the dye to set. Bleaching the dye from the item with a reducing agent prepares it for re-dyeing.

20 Claims, 1 Drawing Sheet

VELVET DYEING KIT AND METHOD

BACKGROUND OF THE INVENTION

1. Field of the Invention

The present invention relates to dyeing textile fabrics. In particular, the present invention relates to a kit for dyeing velvet-covered, untreated, or "greige" goods, under ambient conditions.

2. Discussion of Background

Dyeing of many kinds of fabrics is well known, including dyeing velvet materials. Velvet is a particular structure of fabric that is characterized by yarns woven to a backing and cut in a short, dense pile. The yarns may be made of synthetics or natural fibers. Velvets are made of rayon, nylon, dacron, dacron polyester, cotton, silk and blends of these.

Velvet is not difficult to dye but typical industrial processes involve dipping the material into hot baths under tightly controlled conditions to assure that the finished material has the desired shade of the selected color and the dye has set so that it will not run. Velvets made of synthetic blends are usually dyed black because the appearance of such velvets dyed other colors, especially lighter colors, is not particularly appealing and black hides the shortcomings of the dyeing process well.

An example of a method for dyeing velvet, including dyeing the velvet a color other than black, is described in U.S. Pat. No. 4,557,731 issued to Sasakura et at. Sasakura et al teach a one-step method for dyeing blends of cellulose and nitrogen-containing fibers such as nylon and silk using two different reactive dyes.

Undyed, untreated fabrics are referred to as greige goods, or "gray" goods. Greige fabrics may be dyed according to a number of industrial processes requiring special equipment, controls and elevated temperatures. Although there are dyes for home use, there are none designed to dye velvet-covered greige goods in a variety of colors.

SUMMARY OF THE INVENTION

According to its major aspects and broadly stated, the present invention is a method for dyeing greige goods covered with cellulosic velvet. The invention is also a kit containing measured quantifies of the dye in an applicator plus a finishing solution and a fixer for giving the undyed velvet a sheen if desired, and, optionally, a dye remover and the greige goods themselves.

The velvet is preferably composed substantially of rayon yarn, or a rayon, nylon blend of yarns woven to a nylon or water-based acrylic backing that is attached to a substrate in the form of shoes, belts, handbags, and costume accessories. The dye is cellulose specific and can set in 24 to 48 hours at room temperature and the normal humidity levels found in a home or dress shop. The dye is applied by brushing with an applicator that dispenses a measured amount of dye for a given area of velvet material so that the material saturates with the dye and the shade of the dyed product when set will match a preselected shade. The goods may be bleached with a reducer and re-dyed a different color.

The pre-measured amount of dye for velvet material that will set at room temperature is a very important feature of the present invention. This feature enables convenient, in-the-home dyeing of velvets. A user of the present invention can purchase greige shoes, for example and the dye applicator in a kit that enables accurate dyeing of the shoes, for example, to match a dress. Furthermore, the goods can be subsequently bleached and redyed to match a different dress.

The use of measured and limited amounts of dye, finish, and fixer is another, important feature of the present invention. The amounts of these chemicals are premeasured to be enough but just enough so that it will be a simple matter to know how much to use to achieve the desired result and, just as importantly, there will be no remaining chemicals to be disposed of.

The dye applicator is another feature of the present invention. The applicator will be in the form of a dauber or a "syringe" that permits controlled release of the dye to the goods so that the entire surface can be saturated more uniformly notwithstanding a measured, limited quantity of dye.

The combination of cellulosic velvet mad a cellulose specific dye for use in in-the-home dyeing of such items as handbags, shoes, belts and costume accessories, is a very important feature of the present invention. These types of velvets do not wear well, but for items worn only a few times or perhaps just once, such as shoes for bridesmaids, they are suitable and inexpensive. By combining goods with this type of velvet and at-home dyeing, the consumer can make better use of these goods and can get the colors desired by dyeing them at home rather than rely on the limited available selections of colors in stock in stores. A manufacturer and distributor can stock greige goods and dyeing kits so that the consumer can get the colors desired without the need to stock pre-dyed goods.

Other features and advantages of the present invention will be apparent to those skilled in the art from a careful reading of the Detailed Description of a Preferred Embodiment presented below accompanied by the following drawings.

DETAILED DESCRIPTION OF A PREFERRED EMBODIMENT

The present invention is a kit comprising greige goods and an applicator containing a dye, perhaps also with a finishing solution and a fixer. The present invention is also a kit for use with greige goods that are provided separately but where the kit is designed not only for particular types of greige goods but for particular sizes of goods. The present invention is also a method for dyeing greige goods.

Figure 2:
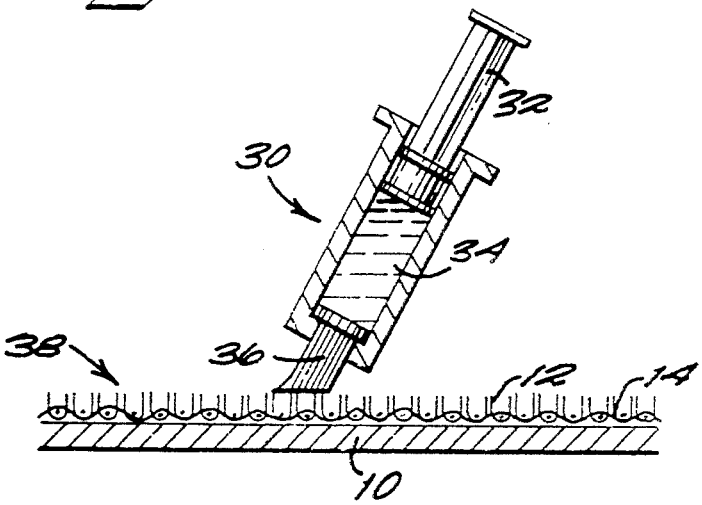
FIG. 2 is a side, cross sectional view showing an alternative embodiment of an applicator applying dye according to a preferred embodiment of the present invention.

Greige goods will be used herein to mean shoes, handbags, belts and costume accessories that have a substrate 10 (FIG. 2) covered with an untreated cellulosic, woven velvet. The velvet comprises warp and weft yarns 12 woven to a backing 14. Costume accessories includes vests and hats and other items that are intended more for limited, perhaps one-time, use as a fashion statement or as part of a costume than as practical clothing. The substrate has the basic shape the goods are to take, such as a shoe form, and then it is covered with the woven velvet.

The velvet is made substantially of cellulosic yarns, that is, those containing 50% or more cellulose-based fibers, particularly yarns of rayon, a rayon warp yarn woven with a nylon, dacron, or dacron polyester weft yam, or yarn for both warp and weft made of a rayon and cotton blend, such as a 50%/50% blend.

The velvet is made by weaving the warp and weft yarns between two backings, each made of nylon or a water-based acrylic having good temperature stability up to approximately 400° F. so that it withstands its attachment to the substrate. The woven structure is then cut to form two pieces of velvet, one backing associated with each piece with the characteristic short, soft pile of the yarns woven to it. The velvet may also be characterized quantitatively by the number of tufts per centimeter. The greater the number of tufts per centimeter, the better the dyed velvet will look but there is no "bright line" number of tufts that determines whether a velvet will be acceptable from a visual standpoint, however, ten tufts per centimeter is a sufficient number for acceptability.

The velvet material is attached to the substrate by hot melting, a process well known to those skilled in the art of laminating synthetic materials and attaching fabrics to substrates.

The dye is preferably a cellulose-specific dye. These dyes are absorbed chemically into the cellulosic yarns at a rate determined in major part by the temperature of the dye and of the environment where the dyeing takes place. When these dyes are used industrially, the temperatures and exposures are precisely controlled so that the shade of each color of dyed fabric is exactly as desired. Hot baths of dye are used to assure that the absorption reaction takes place quickly.

However, these dyes will also set at room temperature, that is, at temperatures less than 100° F. and especially at temperatures in the range of approximately 65° F. to approximately 80° F. and at a relative humidity in the range of approximately 50% to approximately 80%. The fact that the dye requires at least approximately 24 hours but not more than approximately 48 hours to set at room temperature so that it will not run is not such a drawback for in-the-home dyeing as it would be in industrial settings.

To assure accurate coloring, the dose of dye must be correlated to the amount of material to be colored. This means that the amount of dye per square inch applied to the goods must be limited but sufficient to saturate the velvet. Preferably, rather than rely on measurements by the user, the mount of dye is measured and the measured amount placed in an applicator marked with the color, shade and the size or size range of the goods so that the user can select the applicator having the amount and color desired. The dye is applied by using all of the dye in the applicator. For example, a kit might be for a "baby blue, as shown, for a size 7–8 shoe." By using all the dye, the user knows that the shade of the dyed product will match that color indicated by the kit. Furthermore, the user has no chemicals to dispose of.

Figure 1:
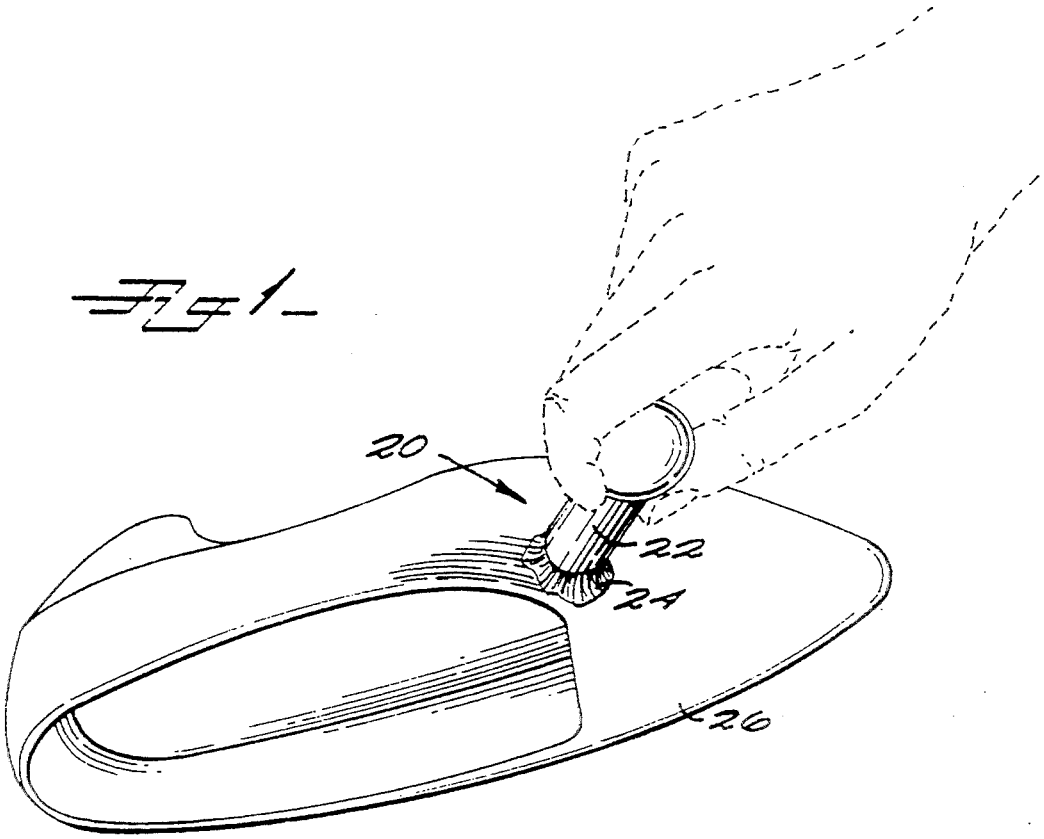
FIG. 1 is a perspective illustration of an applicator applying dye to greige goods, namely a shoe, according to a preferred embodiment of the present invention.

Controlling the amount of dye applied to a given area of velvet material is only a partial control on the appearance of the dyed product. The evenness of application is also important in final appearance. Therefore, the applicator must be designed to limit flow somewhat so that the user can apply the dye evenly over the entire surface before running out. Preferably, an applicator 20 is a container 22 with a dauber 24 that can be saturated with the dye and then brushed over the goods 26 (See FIG. 1 ). Alternatively, for better flow control, the applicator can be of a "syringe" type 30 having a thumb-controlled piston 32 that forces an amount of dye 34 through a porous, resilient applicator tip 36 that applies the dye to the goods 38 (See FIG. 2).

For a different sheen or appearance a clear finishing solution such as an aqueous solution of polyvinyl alcohol can be applied. Preferably this solution would be less than one percent polyvinyl alcohol and most preferably approximately 0.2%. A chemical fixer can be applied after the finishing solution. Boric acid is a suitable fixer. After the fixer has dried, the dye can be applied. No promoters are needed but typical, cellulose-specific dye promoters can be used.

If the user wants to remove the dye, any convenient reducer such as sodium hydrosulfite or thio-ureasulfite adduct, can be used. The shoe may then be dyed a different color.

In use, the greige goods and corresponding dye-filled applicator are obtained together with any finishing solutions and fixers that are desired. The amounts of the chemicals will vary depending on the amount of surface area to be dyed. The finishing solution is applied first, then the fixer, and finally the dye. Each chemical is applied with a separate applicator, preferably one that is convenient to use and not messy, such as a dauber or syringe of the type shown in FIGS. 1 and 2 and described herein. Each applicator is dimensioned to hold a sufficient quantity of chemical, especially the dye, to accomplish its particular purpose and preferably an amount that is just sufficient so that there is no excess after application beyond a modest residue.

The dye is applied preferably by brushing evenly over the goods, saturating the velvet, under room-temperature conditions. Then the goods are permitted to stand for about 24 to 48 hours in order to set. If the user wants to change the color, the reducer is applied in the same manner as the finishing solution and the fixer. The reducer bleaches out the dye so that the goods can be dyed a different color.

It will be apparent to those skilled in the art that many changes and substitutions can be made to the preferred embodiment herein described without departing from the spirit and scope of the present invention as defined by the appended claims.

What is claimed is:

1. In combination, a kit comprising:

a substrate;

a backing attached to said substrate;

undyed cellulosic yarn woven to said backing and cut to form a velvet fabric;

a measured quantity of a cellulose specific color dye, said quantity of dye being just sufficient to saturate said velvet fabric with said color dye to match a preselected shade of said color; and means carrying said measured quantity of said dye for applying said measured quantity of said dye to said velvet fabric.

2. A kit as recited in claim 1, wherein said cellulosic yarn is rayon.

3. A kit as recited in claim 1, wherein said cellulosic yarn is rayon woven as a warp yarn and said velvet fabric further comprises nylon woven as a weft yarn.

4. A kit as recited in claim 1, wherein said cellulosic yarn is a cotton and rayon blend.

5. A kit as recited in claim 1, wherein said backing is a water-based acrylic.

6. A kit as recited in claim 1, wherein said backing is nylon.

7. A kit as recited in claim 1, wherein said velvet has a density of approximately at least ten tufts per centimeter.

8. A kit as recited in claim 1, wherein said applying means is a dauber.

9. A kit as recited in claim 1, further comprising a measured quantity of a clear, aqueous solution of a fabric finish, said quantity being just sufficient for covering said velvet material.

10. A kit as recited in claim 1, further comprising a measured quantity of an aqueous solution of polyvinyl alcohol for finishing said fabric.

11. A kit as recited in claim 1, further comprising a measured quantity of a solution of less than 1% polyvinyl alcohol in water for finishing said fabric.

12. A kit as recited in claim 1, further comprising a measured quantity of a clear, aqueous polyvinyl alcohol solution, said quantity being just sufficient for finishing said velvet material and a measured quantity of boric acid for fixing said polyvinyl alcohol.

13. A kit as recited in claim 1, further comprising a measured quantity of a reducing agent, said measured quantity being sufficient to remove said dye from solid velvet material.

14. A kit as recited in claim 1, further comprising a measured quantity of a reducing agent selected from the group consisting essentially of sodium hydrosulfite and thio-ureasulfite adduct, said measured quantity being sufficient to remove said dye from said velvet material.

15. The kit as recited in claim 1, wherein said applying means further comprises a syringe.

16. A kit for treating goods comprising velvet formed on substantially cellulosic materials woven on a backing that is attached to a substrate, said substrate in the form of such items as shoes, handbags, bolts, and costume accessories, said kit comprising:

a measured quantity of a cellulose specific color dye, said quantity of dye being just sufficient to saturate said velvet fabric with said color dye to match a preselected shade of said color;

means carrying said measured quantity of dye for applying said measured quantity of said dye to said velvet fabric; and a measured quantity of a clear, aqueous solution of a fabric finish, said quantity being just sufficient for covering said velvet fabric.

17. A kit as recited in claim 16, wherein said measured quantity of fabric finish comprises an aqueous solution of polyvinyl alcohol.

18. A kit as recited in claim 16, further wherein said fabric finish comprises a measured quantity of a clear, aqueous polyvinyl alcohol solution, said quantity being just sufficient for finishing said velvet material and a measured quantity of boric acid for fixing said polyvinyl alcohol.

19. A kit as recited in claim 16, further comprising a measured quantity of a reducing agent, said measured quantity being sufficient to remove dye from said velvet material.

20. A kit as recited in claim 16, further comprising a measured quantity of a reducing agent selected from the group consisting essentially of sodium hydrosulfite and thio-ureasulfite adduct, said measured quantity being sufficient to remove dye from said velvet material.

* * * * *